US010662565B2

(12) United States Patent
Biancalani et al.

(10) Patent No.: US 10,662,565 B2
(45) Date of Patent: May 26, 2020

(54) APPARATUS FOR PROCESSING A FABRIC IN A TUMBLER

(71) Applicant: BIANCALANI S.R.L., Prato (IT)

(72) Inventors: Massimo Biancalani, Prato (IT); Riccardo Ravagli, Pistoia (IT)

(73) Assignee: BIANCALANI S.R.L., Prato (IL)

( * ) Notice: Subject to any disclaimer, the term of this patent is extended or adjusted under 35 U.S.C. 154(b) by 209 days.

(21) Appl. No.: 15/559,707

(22) PCT Filed: Mar. 22, 2016

(86) PCT No.: PCT/IB2016/051622
§ 371 (c)(1),
(2) Date: Sep. 19, 2017

(87) PCT Pub. No.: WO2016/151493
PCT Pub. Date: Sep. 29, 2016

(65) Prior Publication Data

US 2018/0251927 A1 Sep. 6, 2018

(30) Foreign Application Priority Data

Mar. 22, 2015 (IT) ..... PO15A000007

(51) Int. Cl.
*D06B 3/24* (2006.01)
*D06C 19/00* (2006.01)
(Continued)

(52) U.S. Cl.
CPC ..... *D06B 3/24* (2013.01); *D06B 23/02* (2013.01); *D06C 19/00* (2013.01); *D06B 3/105* (2013.01)

(58) Field of Classification Search
None
See application file for complete search history.

(56) References Cited

U.S. PATENT DOCUMENTS 2,442,742 A 6/1948 Morrill
4,161,054 A 7/1979 Serracant
7,930,908 B2 * 4/2011 Ciabattini ..... D06B 3/28 68/11

FOREIGN PATENT DOCUMENTS

EP 2 034 076 A1 3/2009
EP 2 535 451 A1 12/2012
(Continued)

OTHER PUBLICATIONS

International Search Report and Written Opinion of the International Searching Authority for corresponding International Patent Application No. PCT/IB2016/051622 dated Jul. 21, 2016, 10 pages.

*Primary Examiner* — Rita P Adhlakha
(74) *Attorney, Agent, or Firm* — Merchant & Gould P.C.

(57) ABSTRACT

An apparatus processes a fabric by repeated brushing on itself includes a process tumbler, provided with a feed duct for feeding the fabric in open-width form continuously between an infeed port and an outfeed port of the feed duct. An adjustment device for adjusting the passage section of the duct and associated with at least one of the ports. The adjustment device causes the passage section to be narrowed so that the fabric, which reaches the port in open-width form and is made to pass through a port in a first feed direction, is bunched into rope form and then allows the fabric, when made, to pass in the opposite direction through the narrowed passage section. The fabric is subtended by the other, wide port of the feed duct, to be stretched out from the rope form to the open-width form.

9 Claims, 5 Drawing Sheets

(51) Int. Cl.
*D06B 23/02* (2006.01)
*D06B 3/10* (2006.01)

(56) References Cited

FOREIGN PATENT DOCUMENTS

| | | | |
|---|---|---|---|
| GB | 118 755 | A | 9/1918 |
| GB | 2 158 472 | A | 11/1985 |
| WO | 2006/021978 | A1 | 3/2006 |
| WO | 2011/138810 | A1 | 11/2011 |
| WO | 2013/105054 | A1 | 7/2013 |

* cited by examiner

APPARATUS FOR PROCESSING A FABRIC IN A TUMBLER

This application is a National Stage Application of PCT/IB2016/051622, filed 22 Mar. 2016, which claims benefit of Serial No. P02015A000007, filed 22 Mar. 2015 in Italy and which applications are incorporated herein by reference. To the extent appropriate, a claim of priority is made to each of the above disclosed applications.

TECHNICAL FIELD

This invention addresses the textile industry and relates in particular to an apparatus and a method for producing brushed effects on a fabric in a tumbler for processing the fabric continuously and in open-width form.

PRIOR ART

In the textile industry, it is a known practice to subject certain types of fabric such as, for example, raised knitted fabrics such as fleece or plush to repeated brushing treatments of the fabric on itself in order to raise the pile and/or give it an appearance which can be likened, for example, to lamb fur.

This action is obtained on the fabric which has been brought into its characteristic "rope form", that is to say, a state in which the fabric is bunched on itself so that its transversal cross section is narrowed down to a minimum, completely the contrary of how it lies when in a substantially flat state known instead as "open-width form"

The treatment by which the fabric in rope form is brushed on itself is performed in the prior art using equipment known in the industry as discontinuous tumblers.

The treatment may also include injecting steam into the tumbler in order to enhance the effect of the treatment by the addition of moisture and heat on the fabric while it is being brushed.

This operating method, although widely used, is not free of disadvantages, however.

Indeed, a tumbler which treats the fabric in rope form feeds out a fabric in rope form—that is, a bunched and creased semifinished fabric—which must then be treated in another machine, that is, in a machine known as rope opener, which opens out the fabric and returns it to its open-width form, that is, a state which is essential for further processing to be carried out on the fabric.

All of this means, in a nutshell, that conventional processing involves the sequential passage of the whole fabric in the two distinct states—first rope form and then open-width form—and the corresponding sequential use of two distinct machines, all of this having evident negative implications in terms of plant, production and costs.

DISCLOSURE OF THE INVENTION

The aim of this invention is, therefore, to overcome the above mentioned disadvantages. According to the invention, this aim is achieved by an apparatus and a method whose technical features are set out in one or more of the appended claims.

The advantages of the invention are more apparent from the following detailed description made with reference to the accompanying drawings which illustrate a preferred, non-limiting embodiment of the invention

EMBODIMENT OF THE INVENTION

Figure 1:
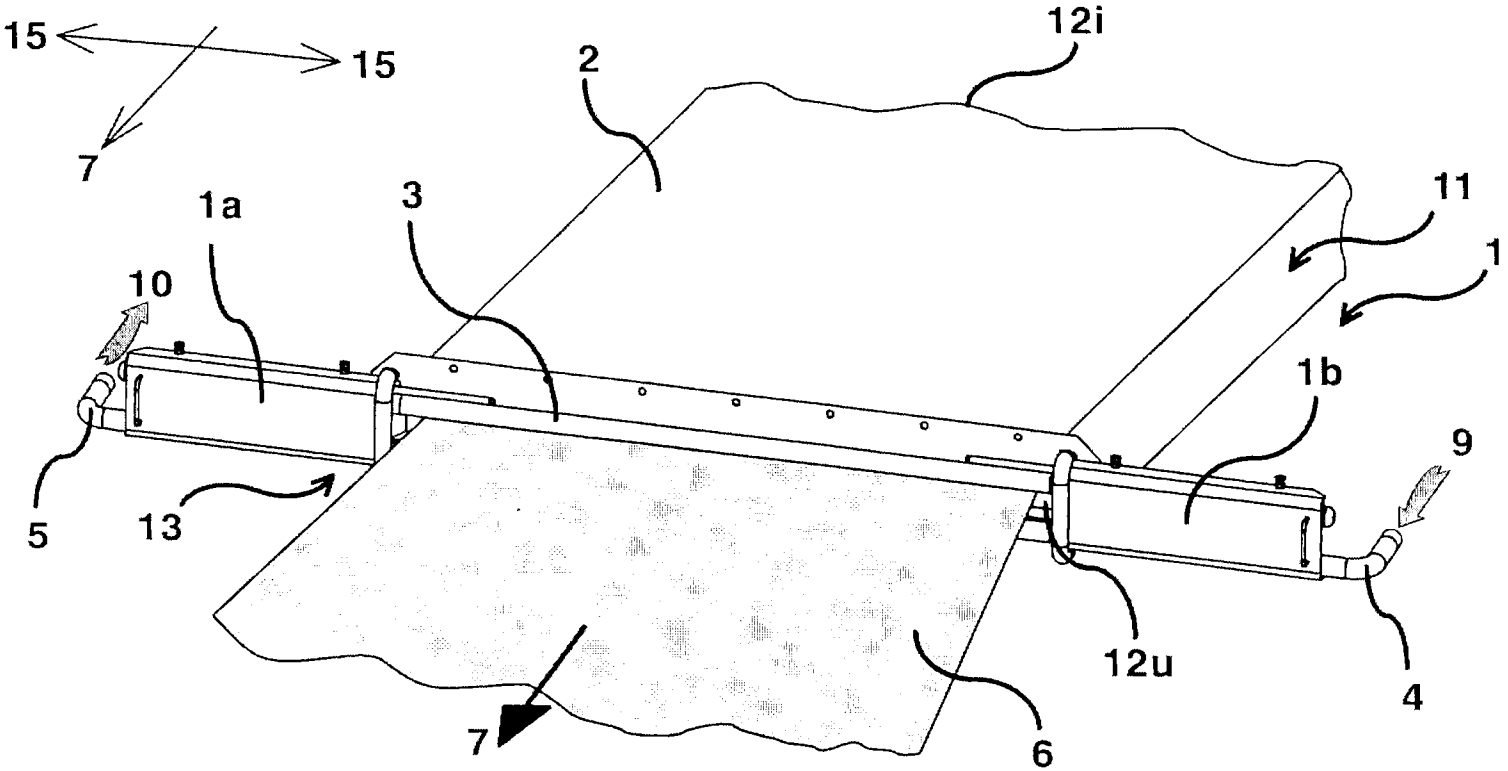
FIG. 1 is a partial perspective view of a continuous, open-width tumbler, illustrated in a first, open-width operating configuration of a port of its fabric feed duct.

With reference to the accompanying drawings, the numeral 1 denotes in its entirety an apparatus for treating a fabric 6, designed to produce on the fabric 6 special aesthetic and/or functional effects by a process which can be likened to a sort of repeated action of brushing the fabric on itself.

The apparatus 1 comprises, in particular, a tumbler 11 (see FIGS. 4 and 5) for treating the fabric 6 and equipped with a feed duct 2 in which the fabric 6 is fed along a longitudinal direction 7 and moves in a condition in which it is in its open-width form continuously between an infeed port 12*i* and an outfeed port 12*u* of the duct 2.

At least at one of the two ports 12*i* and 12*u* of the duct 2, the apparatus comprises an adjustment device 13 for adjusting the passage section—and more specifically, for reducing the size—of the port 12*u* with which the adjustment device 13 is directly associated.

Figure 2:
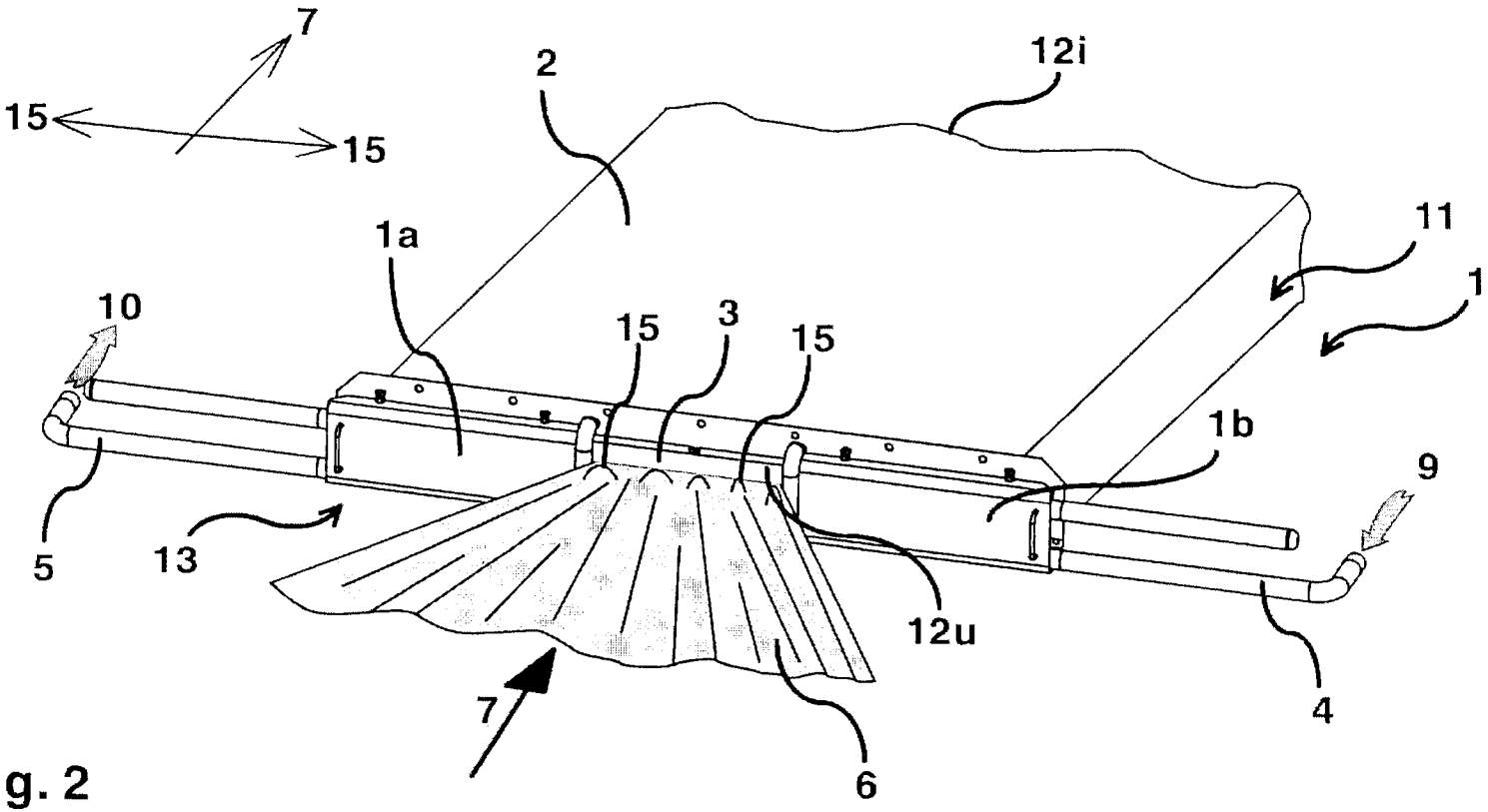
FIG. 2 is a partial perspective view of the tumbler of FIG. 1 in a first, rope operating configuration of a port of its fabric feed duct.

As may be seen from FIG. 2, and in particular by comparing it with FIG. 1, the adjustment device 13 is capable of working in such a way as to narrow the passage section of the port 12*u* from its initial, fully open condition, equal to the full cross section of the duct 2, to a narrowed cross section as shown, for example, in FIG. 2.

The purpose of this adjustment is to cause the incoming fabric 6, which is moving in open-width form, to pass to a narrowed condition, or in any case to a condition which is more compact than its starting condition and which is very close to what is known as its rope form and, in any case, equivalent to the rope form for the purposes of the technical effects typically correlated therewith.

More specifically—as shown in FIG. 1—the fabric which has reached the port 12*u* in open-width form and passes through the port 12*u* (feeding along a direction 7 substantially longitudinal of the fabric 6) is transversely narrowed and bunched in such a way as to form pleat-like folds 15 which tend—locally and at the port 12*u*—to come into contact in such a way as to rub each other.

By reversing the feed movement along the direction 7—that is to say, by causing it to move backwards through the passage section of the narrowed port 12*u*—as clearly shown in FIG. 2—the fabric 6 simultaneously subtended between the narrowed outfeed port 12*u* and the wide infeed port 12*i*, tends to spontaneously return to the open-width state and to stretch out the previously formed pleat-like folds 15. Causing the fabric 6 to move alternately backwards and forwards through the port 12*u* along the direction 7 subjects it to cyclic actions which make it pass from the open-width form to the rope form and vice versa, thereby rapidly producing in the fabric 6—for example a raised knitted fabric 6—the typical effects otherwise obtained by the working combination of a conventional rope tumbler and a rope opening machine installed in cascade with each other.

Figure 3:
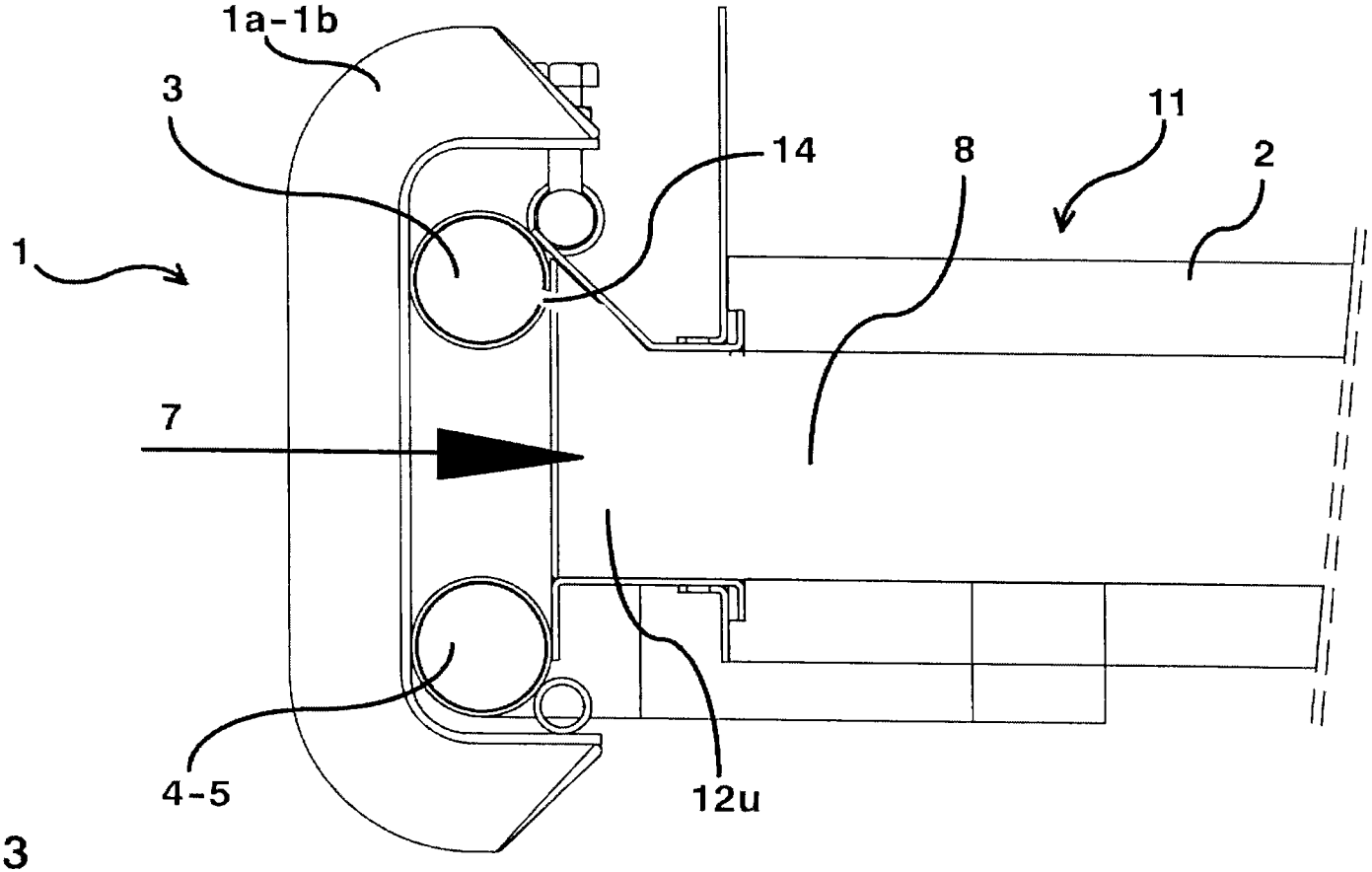
FIG. 3 is a scaled-up cross section of a detail of the invention of the preceding figures.

From FIGS. 1-3 it may be observed in particular that the adjustment device 13 comprises two sliding shutters 1*a* and 1*b* which run in a guide 3 along a direction of motion 15 transversal to the fabric 6 and substantially parallel to the plane in which the fabric moves in the feed duct 2.

Preferably, the two sliding shutters 1*a* and 1*b* run along the guide 3 simultaneously and in opposite directions towards and away from each other in such a way as to create in the port 12*u* a narrowed passage section which is substantially centred about the centre line of the port 12*u*, that is, about the centre line of the fabric 6 passing through the section.

The adjustment device 13 for adjusting the passage section is also equipped with means for treating the fabric 6 with steam, including small ejectors 14 which inject steam into the duct 2 to treat the fabric 6 with steam while it is being processed.

In a preferred embodiment of them, these treatment means are integrated in the component parts of the adjustment device 13 for adjusting the passage section of the port 12*u*.

In effect, it should be noted, in particular from FIG. 3, that the guide 3 of the sliding shutters 1*a* and 1*b* is embodied by a hollow, tubular bar 3, provided with steam ejectors 14 supplied by a manifold 4 which is in communication with the bar 3 and which is in turn supplied by a flow 9 of steam from steam generating means, which are not illustrated in the accompanying drawings because they are irrelevant to this invention.

Also connected to the tubular bar 3 is a steam condensate trap 5 which collects the condensed steam and extracts it from the device 13 in the form of an outflow labelled 10 in the drawings.

Figure 4:
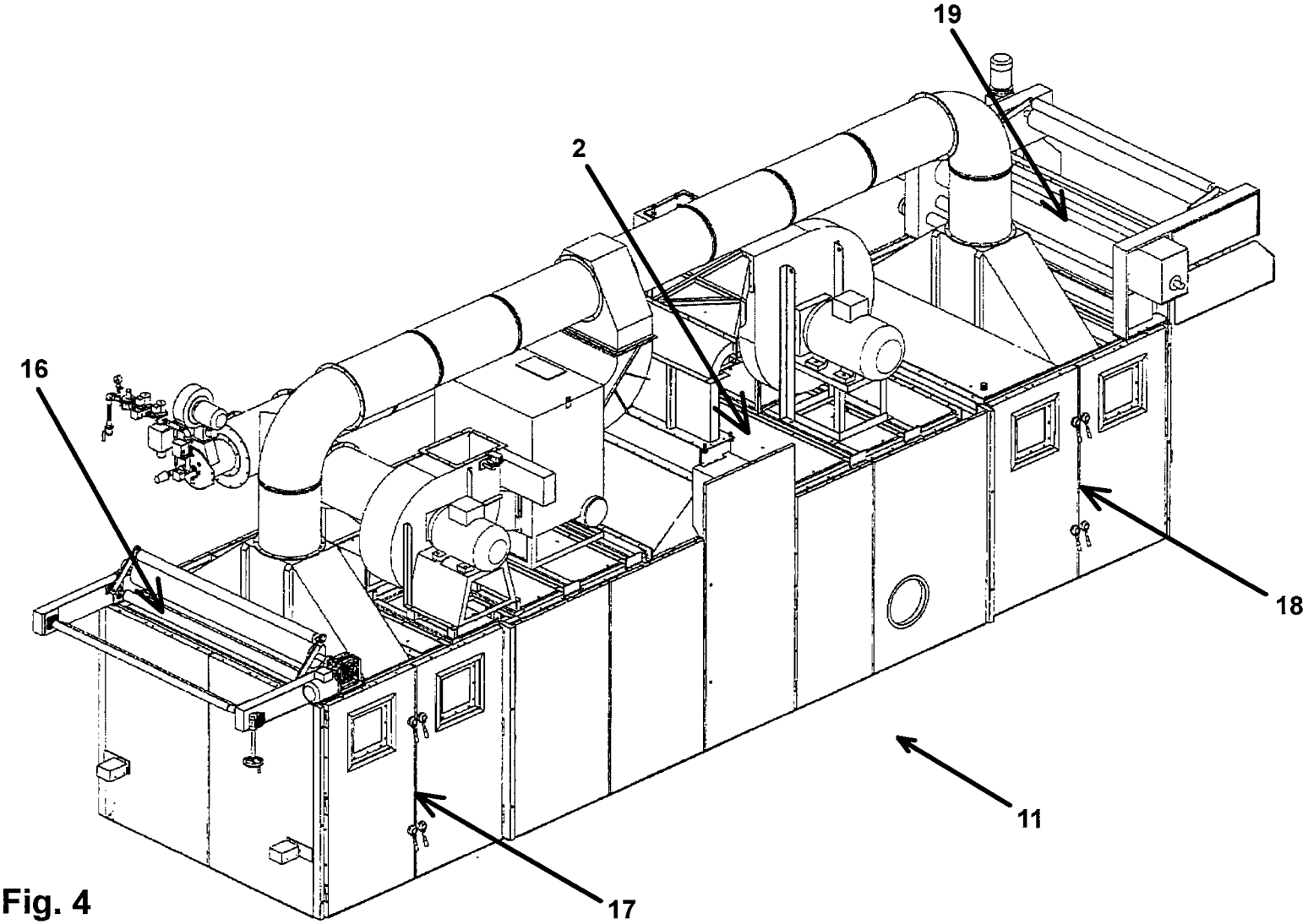
FIG. 4 shows a typical example of a machine operating continuously for treating a fabric in open-width form with tumbler effect.

FIG. 4 is a typical example of machine 11 operating continuously for treating a fabric in open-width form with tumbler effect. The fabric 6 is fed through a first roller 16 in a first accumulation 17 and then is transferred alternately from the pneumatic ejector duct 2 in a second accumulation 18, from where it is withdrawn continuously from a second roller 19 and exits from the machine.

Figure 5:
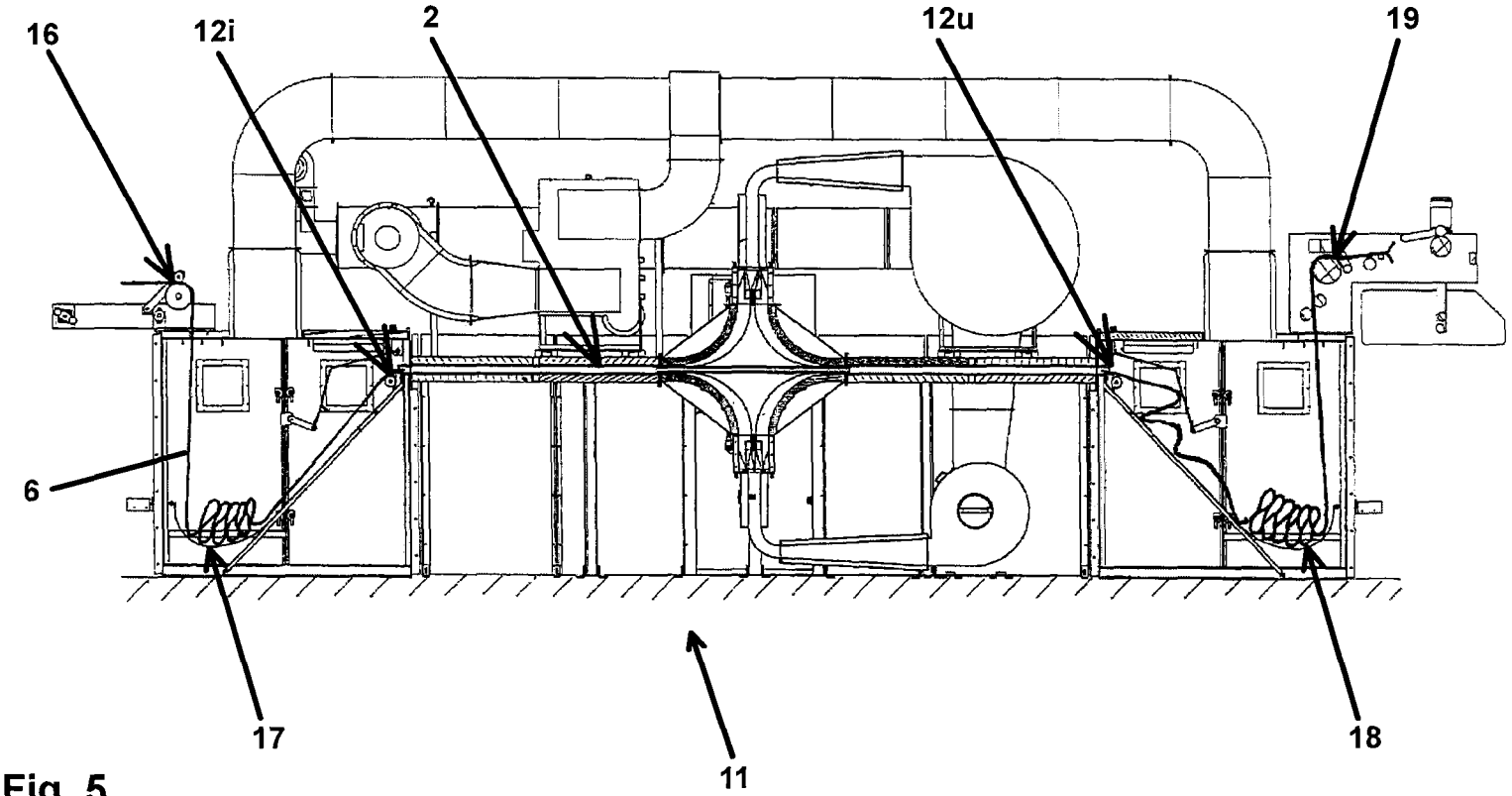
FIG. 5 is a longitudinal cross section of the machine shown in FIG. 4.

FIG. 5 is the longitudinal section view of the machine of FIG. 4 where it is possible to follow the entire path of the fabric 6 into the machine. The roller 16 feeds the first accumulation 17 and the fabric, alternately, enters into the mouth 12*i* and comes out of the mouth 12*u* of the pneumatic duct. Then the fabric falls in the accumulation 18, from where it is withdrawn.

The apparatus 1 as described above allows implementing a method for processing a fabric by repeated brushing localized on itself and which comprises the following steps:

feeding a portion of fabric 6 in open width form alternately to and fro through a narrowed section of at least one of the ports 12*i* and 12*u* of a continuous tumbler 11 for processing the fabric 6;

repeating this feeding step until the effects produced on the fabric 6, alternately narrowed in rope form and widened in open-width form, correspond to the effects of brushing on itself; and lastly extracting the fabric 6 from the tumbler 11 through one of the ports 12*i* and 12*u*.

The method may also advantageously comprise a step of injecting stem 9 onto the fabric 6 being processed, this step being performed preferably at the port 12*i* and/or 12*u* of the duct 2, narrowed by the adjustment device 13.

The invention claimed is:

1. An apparatus for processing a fabric by repeated brushing on the fabric, the apparatus comprising a tumbler for processing the fabric, provided with a feed duct for feeding the fabric in open-width form continuously between an infeed port and an outfeed port of the duct; an adjustment device for adjusting a passage section of the duct and associated with the duct at least at one of the ports; the adjustment device causing the passage section to be narrowed in such a way that the fabric, which reaches the port in open-width form and is made to pass through the port in a first feed direction, is bunched into rope form and then allows the fabric, when the fabric is made to pass in an opposite direction through the narrowed passage section, where the narrowed passage section is subtended by the other, wide port of the duct, to be stretched out from the rope form to the open-width form again.

2. The apparatus according to claim 1, wherein the fabric is a raised knitted fabric.

3. The apparatus according to claim 1, wherein the adjustment device comprises, associated with one or each of the ports of the feed duct, at least one sliding shutter which runs in a guide along a direction of motion transversal to the fabric and substantially parallel to the plane in which the shutter lies inside the duct.

4. The apparatus according to claim 3, comprising two of the at least one sliding shutter movable in a guide along the direction of motion simultaneously towards and away from each other.

5. The apparatus according to claim 1, comprising means for treating the fabric with steam and associated with at least one of the ports of the feed duct.

6. The apparatus according to claim 5, wherein the means for treating the fabric with steam include ejector means for injecting steam and associated with the guide of the shutter.

7. A method for processing a fabric by repeated brushing localized on the fabric with the apparatus for processing a fabric according to claim 1, the method comprising the following steps:

feeding a portion of fabric in open width form alternately to and fro through a narrowed section of at least one of a plurality of ports of a continuous tumbler for processing the fabric;

repeating the feeding step until effects produced on the fabric, alternately narrowed in rope form and widened in open-width form, correspond to the effects of brushing on the fabric; and extracting the fabric from the tumbler through one of the ports.

8. The method according to claim 7, comprising a step of injecting steam onto the fabric being processed.

9. The method according to claim 8, wherein the injecting step is performed at the port of the duct, narrowed by the adjustment device.

* * * * *